US006078239A

United States Patent [19]

Hu

[11] Patent Number: 6,078,239

[45] Date of Patent: Jun. 20, 2000

[54] HIGH FREQUENCY TRANSFORMER

[75] Inventor: Suzhen Hu, 7#403, P.O. Box 912, Haidian District, Beijing 100083, China

[73] Assignees: Suzhen Hu; Li Zhang, both of Beijing, China

[21] Appl. No.: 09/091,961

[22] PCT Filed: Dec. 27, 1996

[86] PCT No.: PCT/CN96/00118

§ 371 Date: Jun. 26, 1998

§ 102(e) Date: Jun. 26, 1998

[87] PCT Pub. No.: WO97/24735

PCT Pub. Date: Oct. 7, 1997

[30] Foreign Application Priority Data

Dec. 28, 1995 [CN] China ..... 95229317

[51] Int. Cl.[7] ..... H01F 27/02; H01F 27/28

[52] U.S. Cl. ..... 336/82; 336/192; 336/223

[58] Field of Search ..... 336/82, 223, 222, 336/221, 55, 192, 233, 234

[56] References Cited

U.S. PATENT DOCUMENTS

| | | | |
|---|---|---|---|
| 2,901,713 | 8/1959 | Hartmann | 336/82 |
| 3,305,662 | 2/1967 | Praeg | 336/82 |
| 3,414,855 | 12/1968 | Rogers | 336/82 |
| 4,868,532 | 9/1989 | Ehrenhalt et al. | 336/223 |
| 4,983,859 | 1/1991 | Nakajima et al. | 336/55 |
| 5,705,971 | 1/1998 | Skibinski | 336/223 |

FOREIGN PATENT DOCUMENTS

| | | | |
|---|---|---|---|
| 261059 | 8/1960 | Australia | 336/223 |
| 2147628Y | 11/1993 | China . | |
| 0072151 | 7/1982 | European Pat. Off. . | |
| 601225 | 6/1994 | European Pat. Off. . | |
| 2 642 566 | 1/1989 | France . | |
| 3037 055 | 5/1982 | Germany . | |
| 3928223 | 8/1988 | Germany . | |
| 275143 | 7/1970 | U.S.S.R. | 336/82 |

*Primary Examiner*—Thomas J. Kozma

*Attorney, Agent, or Firm*—Todd E. Garabedian; Wiggin & Dana

[57] ABSTRACT

A high-frequency transformer, comprises: a ring core made of amorphous magnetic material; a core protection box made of conductive material and enclosing the ring core; and a high-voltage winding, consisting of enamel-insulated wire wound on the core protection box. Wherein, on the ring top wall of the core protection box there is a ring gap in the peripheral direction, and at inner fringe and outer fringe of the ring gap, a plurality of leading wires are respectively arranged in the peripheral direction. The leading wires at inner fringe and outer fringe of the ring gap are electrically-connected together respectively and form two terminals. The core protection box and the two terminals constitute low-voltage winding of the high-frequency transformer. If the low-voltage winding comprises two or more core protection boxes, it can have a central tap or have multi-turn. A thus fabricated high-frequency transformer has a smaller size, a lighter weight and is more apt to industrial batch manufacture. Further, the magnetic coupling between the high-voltage winding and the low-voltage winding can be increased.

6 Claims, 1 Drawing Sheet

HIGH FREQUENCY TRANSFORMER

BACKGROUND OF THE INVENTION

1. Field of the Invention

The present invention relates to a high-frequency transformer for an inverse-convert welding machine and power supply apparatuses.

2. Description of the Related Art

A conventional high-frequency transformer using cores made of amorphous soft magnetic material is easy to achieve high saturation magnetic flux and permeability. However, this amorphous soft magnetic material is soft and fragile, and very easy to get damaged. In practical application it is often kept in a protection box.

Chinese Utility Model No.942455290.0 disclosed a wing-plate shaped, non-magnetic metal protection box for the ring amorphous soft magnetic material core of a high-frequency transformer. On the external wall of the protection box, outwards-radiated wing-plate heat-sinks were provided, so the heat-dissipation area is increased, and the heat produced due to iron loss will be easier to be radiated out. Thus it overcomes the difficulty of heat dissipation of plastic or of bakelite core-protection box under high frequency condition.

But, since the wing-plate heat-sink is very long, the size of the high-frequency transformer using the core protection box is increased, the wound wire of its winding is lengthened, thus the coupling between high-voltage winding and low-voltage winding is less tight, magnetic leakage of windings and heat loss of windings increase.

SUMMARY OF THE INVENTION

The object of the invention is to provide a high-frequency transformer, which has a smaller size, a lighter weight, and a higher magnetic coupling coefficient between the high-voltage winding and the low-voltage winding, and thus has a smaller leakage inductance, as compared with the high-frequency transformer of the prior art.

Another object of the invention is to provide a high-frequency transformer with central tap in its low-voltage winding, which has a smaller size, a lighter weight, and a higher magnetic coupling coefficient between the high-voltage winding and the low-voltage winding, and thus has a smaller leakage inductance, as compared with the high-frequency transformer of the prior art.

To this end, a high-frequency transformer according to the invention comprises:

- a ring core made of amorphous magnetic material;
- a core protection box made of conductive material and enclosing the ring core;
- a high-voltage winding, consisting of enamel-insulated wire wound on the core protection box.

Wherein, the shape of the core protection box is similar to that of the ring core. On the ring top wall of the core protection box there is a ring gap in the peripheral direction, and at inner fringe and outer fringe of the ring gap, a plurality of leading wires electrically connected with the core protection box are respectively arranged in the peripheral direction. The leading wires at inner fringe and outer fringe of the ring gap are electrically-connected together respectively and form two terminals. The core protection box and the two terminals constitute low-voltage winding of the high-frequency transformer.

A high-frequency transformer with central tap in its low-voltage winding according to the invention comprises:

- a ring core made of amorphous magnetic material;
- a core protection box made of conductive material and enclosing the ring core;
- a high-voltage winding consisting of enamel-insulated wire wound on the core protection box.

Wherein, the core protection box consists of a first core protection box and a second core protection box. The shapes of the first core protection box and the second core protection box are similar to that of the ring core. The first core protection box wraps the ring core directly. The second core protection box electrical-insulated wraps the first core protection box. A first ring gap is arranged on a first ring top wall of the first core protection box in the peripheral direction, and a second ring gap is arranged on a second ring top wall of the second core protection box in the peripheral direction. The first ring gap corresponds to the second ring gap. One of the inner and outer fringes of the first ring gap is electrically connected with the opposite fringe of the second ring gap. On the ring walls of the core protection boxes adjacent closely to the unconnected fringes of the first ring gap and the second ring gap, a first set of leading wires and a second set of leading wires are respectively arranged in the peripheral direction and electrically connected with the first core protection box and the second core protection box, respectively. On one of the ring walls of the core protection boxes adjacent closely to the fringes that have been connected together, a third set of leading wires are arranged in the peripheral direction and electrically connected with the corresponding core protection box. On the second ring top wall, a plurality of pre-reserved holes, which correspond to the positions of the first set of leading wires on the first core protection box, are opened. The third set of leading wires and the second set of leading wires are electrically connected together, respectively, and form a third terminal and a second terminal. The first set of leading wires pass through corresponding pre-reserved holes and then are connected together to form a first terminal. The core protection box, the first terminal, the second terminal and the third terminal constitute the low-voltage winding with central tap.

BRIEF DESCRIPTION OF THE DRAWINGS

The following is a detailed descriptions of the high-frequency transformer according to the invention in connection with the drawings.

DETAILED DESCRIPTION OF THE PREFERRED EMBODIMENTS

Figure 1:
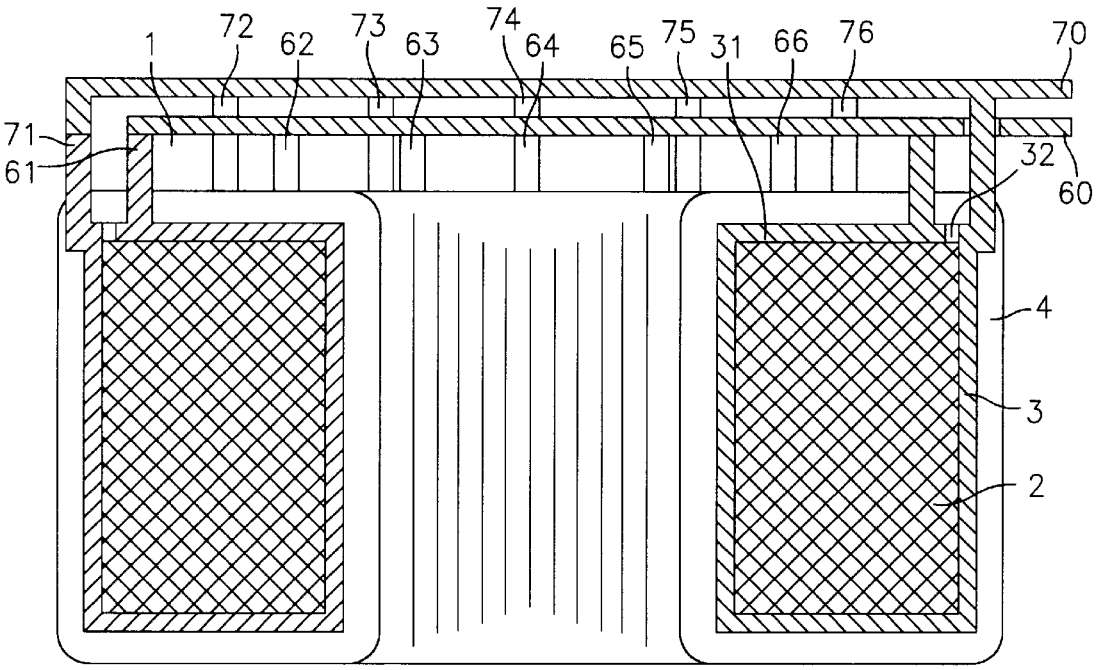
FIG. 1 is a sectional view of the high-frequency transformer of the present invention.

FIG. 1 is a sectional view of the high-frequency transformer according to the present invention. The high-frequency transformer 1 consists mainly of the following components: a ring core 2 made of amorphous magnetic material; a core protection box 3 wrapping the ring core 2; a high-voltage winding 4 consisting of an enamel-insulate wire wound on the core protection box. The core protection box 3 is made of a conductive material and has a shape similar to that of the ring core 2. The conductive material is preferably aluminum, and more preferably copper. In the present invention, the core protection box serves both as a protector for the ring core made of amorphous soft magnetic material, and as the low-voltage winding of the high-frequency transformer. On the ring top wall 31 of the core protection box 3, a ring gap 32 is arranged in the peripheral direction. On the inner fringe and the outer fringe of the ring gap 32, a plurality of leading wires 61, 62, 63, 64, 65, 66; 71, 72, 73, 74, 75, 76 are respectively arranged in an even way in the peripheral direction and electrically connected with the core protection box. These leading wires can be cylindrical or other shapes. The leading wires 61, 62, 63, 64, 65, 66 at the inner fringe of the ring gap 32 pass through the high-voltage winding and then are electrically connected together to form a terminal 60. The leading wires 71, 72, 73, 74, 75, 76 at the outer fringe of the ring gap 32 are connected in similar way to form another terminal 70. These two terminals 60, 70 make up lead-outs of the low-voltage winding of the high-frequency transformer of the invention. The high-voltage winding 4 of the high-frequency transformer is formed by an enamel-insulated wire wound directly on the core protection box 3 in an electrically insulated way, these wires being evenly distributed between the leading wires of the low-voltage winding.

Figure 2:
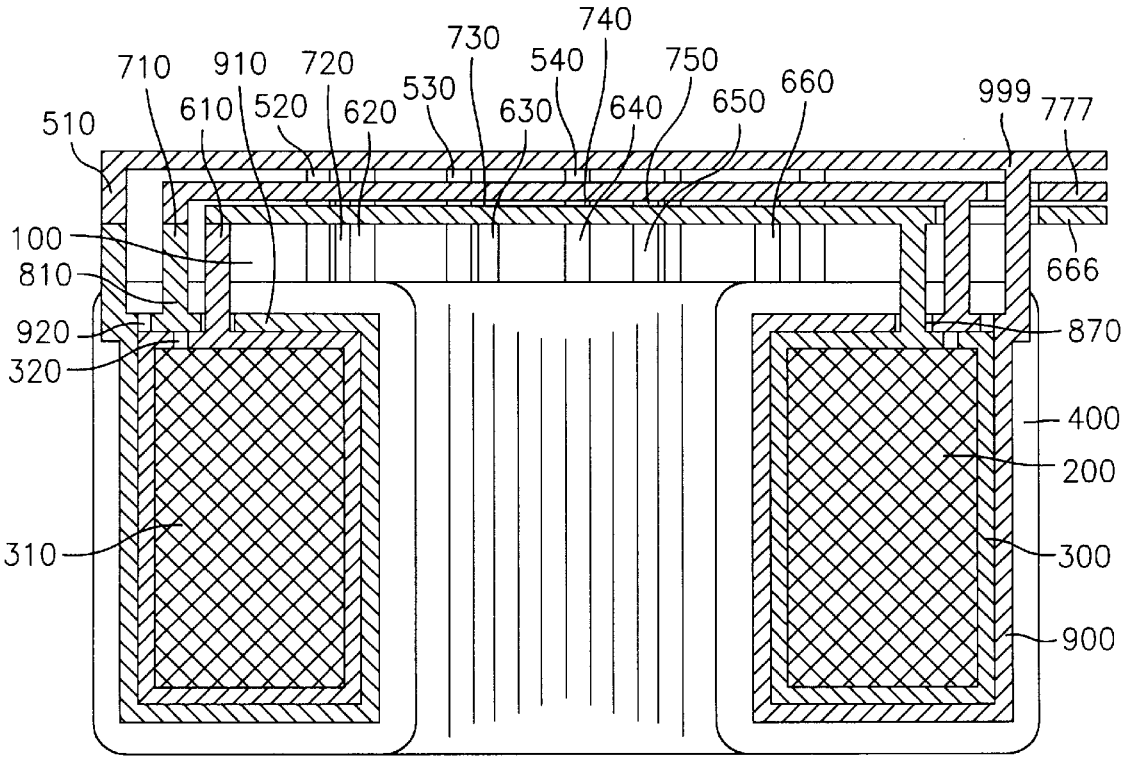
FIG. 2 is a sectional view of the high-frequency transformer with central tap in its low-voltage winding according to the present invention.

FIG. 2 is a sectional view of the high-frequency transformer with central tap in its low-voltage winding according to the present invention. It can be seen from the figure that the structure of the high-frequency transformer 100 with central tap in its low-voltage winding according to the present invention is similar to that of the high-frequency transformer showed in FIG. 1. The difference lies in that, in this case the core protection box comprises a first core protection box 300 and a second core protection box 900. The first core protection box 300 is encased in the second core protection box 900 in electrically insulated way. On a first ring top wall 310 of the first core protection box 300, a first ring gap 320 is opened. Correspondingly, on a second ring top wall 910 of the second core protection box 900, a second ring gap 920 is opened. One of the inner fringe and the outer fringe (e.g. the outer fringe) of the ring gap 320 is electrically connected with the opposite fringe (e.g. the inner fringe) of the ring gap 920. On the walls of the core protection box, adjacent closely to the unconnected fringes of the ring gaps 320 and 920, a first set of leading wires 610, 620, 630, 640, 650, 660 and a second set of leading wires 510, 520, 530, 540 are respectively distributed in an even way in the peripheral direction and electrically connected with the first core protection box 300 and the second core protection box 900 respectively. On the wall of the core protection box next to the one of the connected fringes (e.g. the inner fringe of the second ring gap 920 of the second core protection box 900), a third set of leading wires 710, 720, 730, 740, 750 are evenly distributed in the peripheral direction and electrically connected with the corresponding core protection box. On the second ring top wall 910 a plurality of pre-reserved holes 810, 870, which correspond to the positions of the first set of leading wires 610, 620, 630, 640, 650, 660 on the first core protection box, are opened so that the first set of leading wires 610, 620, 630, 640, 650, 660 can pass through the corresponding pre-reserved holes 810, 870, and then are connected together to form a first terminal 666. The second set of leading wires 510, 520, 530, 540 and the third set of leading wires 710, 720, 730, 740, 750 are electrically connected together respectively to form a second terminal 999 and a third terminal 777. The core protection boxes 300 and 900, the first terminal 666, the second terminal 999 and the third terminal 777 constitute a low-voltage winding of the high-frequency transformer of the present invention, the third leading terminal 777 serving as the central tap of the low-voltage winding of the high-frequency transformer.

In the text above, the high-frequency transformer with central tap in its low-voltage winding according to the invention has been described in the form of embodiment. The low-voltage winding of the high-frequency transformer includes two core protection boxes made of electrically conductive material. However, those persons skilled in the art should appreciate that, if a low-voltage winding of a high-frequency transformer comprises more core protection boxes connected in a similar manner, a transformer having a multi-turn low-voltage winding with or without central tap can be obtained to adapt lower frequency or higher output voltage. Any improved transformer will fall into the protection scope of the present invention without departing from the spirits of the invention.

INDUSTRIAL APPLICABILITY

In the high-frequency transformer of the present invention, since the core protection box of the ring core is made of electrically conductive material, and serves as its low-voltage winding, a low-voltage winding wound on the core protection box in the prior art is eliminated, thus the structure of the high-frequency transformer become more compact, and it is smaller in size, lighter in weight, and is more apt to industrial batch manufacture. Since the high-voltage winding is tightly wound on the core protection box, the magnetic coupling between the high-voltage winding and the low-voltage winding is increased, so the leakage inductance is reduced and thus the loss is reduced as well.

What is claimed is:

1. A high-frequency transformer (1), comprises:

a ring core (2) made of amorphous magnetic material;

a core protection box (3) made of conductive material and enclosing said ring core (2);

a high-voltage winding (4), consisting of enamel-insulated wire wound on said core protection box (3), characterized in that, the shape of said core protection box (3) is similar to that of said ring core (2), on a ring top wall (31) of said core protection box (3) there is a ring gap (32) in the peripheral direction, and at an inner fringe and an outer fringe of said ring gap (32), a plurality of leading wires (61, 62, 63, 64, 65, 66; 71, 72, 73, 74, 75, 76) electrically connected with said core protection box (3) are respectively arranged in the peripheral direction, said leading wires (61, 62, 63, 64, 65, 66) at inner fringe and said leading wires (71, 72, 73, 74, 75, 76) at outer fringe of said ring gap (32) are electrically-connected together respectively and form two terminals (60, 70), said core protection box (3) and said two terminals (60, 70) constitute a low-voltage winding of said high-frequency transformer (1).

2. A high-frequency transformer according to claim 1, characterized in that said core protection box (3) is made of copper.

3. A high-frequency transformer according to claim 1, characterized in that said core protection box (3) is made of aluminum.

4. A high-frequency transformer (100), comprises:

a ring core (200) made of amorphous magnetic material;

a core protection box (300, 900) made of conductive material and enclosing said ring core (200);

a high-voltage winding (400) consisting of enamel-insulated wires wound on said core protection box (300, 900), characterized in that, said core protection box (300, 900) consists of a first core protection box (300) and a second core protection box (900), the shapes of said first core protection box (300) and said second core protection box (900) are similar to that of said ring core (200), said first core protection box (300) wraps said ring core (200) directly, said second core protection box (900) electrically-insulated wraps said first core protection box (300), a first ring gap (320) is arranged on a first ring top wall (310) of said first core protection box (300) in the peripheral direction, and a second ring gap (920) is arranged on a second ring top wall (910) of said second core protection box (900) in the peripheral direction, said first ring gap (320) corresponds to said second ring gap (920), one of the inner and outer fringes of the first ring gap (320) is electrically connected with the opposite fringe of said second ring gap (920), on the walls of the core protection box adjacent closely to the unconnected fringes of said first ring gap (320) and said second ring gap (920), a first set of leading wires (610, 620, 630, 640, 650, 660) and a second set of leading wires (510, 520, 530, 540) are respectively arranged in the peripheral direction and electrically connected with said first core protection box (300) and said second core protection box (900), respectively, on one of the walls of said core protection box adjacent closely to said fringes that have been connected together, a third set of leading wires (710, 720, 730, 740, 750) are arranged in the peripheral direction and electrically connected with the corresponding core protection box (300, 900), on said second ring top wall (910), a plurality of pre-reserved holes (810, 870), which correspond to the positions of said first set of leading wires (610, 620, 630, 640, 650, 660) on said first core protection box (300), are opened, said third set of leading wires (710, 720, 730, 740, 750) and said second set of leading wires (510, 520, 530, 540) electrically connected together, respectively, and form a third terminal (777) and a second terminal (999), said first set of leading wires (610, 620, 630, 640, 650, 660) pass respectively through said pre-reserved holes (810,870) and then are connected together to form a first terminal (666), said core protection box (300, 900), said first terminal (666), said second terminal (999) and said third terminal (777) constitute the low-voltage winding with central tap of said high-frequency transformer (100).

5. A high-frequency transformer according to claim 4, characterized in that said core protection box (300, 900) is made of copper.

6. A high-frequency transformer according to claim 4, characterized in that said core protection box (300, 900) is made of aluminum.

* * * * *